US010358281B2

(12) United States Patent
Carpenter et al.

(10) Patent No.: US 10,358,281 B2
(45) Date of Patent: Jul. 23, 2019

(54) ACTUATOR ASSEMBLY FOR A PRESSURIZED PLASTIC VESSEL

(71) Applicant: Bayer HealthCare LLC, Whippany, NJ (US)

(72) Inventors: Michael Scott Carpenter, Arlington, TN (US); John Kevin Clay, Fairfield, CT (US); Ricardo Felix Perez, New Haven, CT (US); Daniel Peter Sterling, Fairfield, CT (US)

(73) Assignee: BAYER HEALTHCARE LLC, Whippany, NJ (US)

( * ) Notice: Subject to any disclaimer, the term of this patent is extended or adjusted under 35 U.S.C. 154(b) by 0 days.

(21) Appl. No.: 16/155,670

(22) Filed: Oct. 9, 2018

(65) Prior Publication Data

US 2019/0039815 A1 Feb. 7, 2019

Related U.S. Application Data

(63) Continuation of application No. 14/908,660, filed as application No. PCT/US2014/048359 on Jul. 28, 2014, now abandoned.

(60) Provisional application No. 61/860,500, filed on Jul. 31, 2013.

(51) Int. Cl.

| | |
|---|---|
| ***B65D 83/20*** | (2006.01) |
| ***B65D 83/40*** | (2006.01) |
| ***B65D 83/38*** | (2006.01) |

(52) U.S. Cl.

CPC ..... *B65D 83/205* (2013.01); *B65D 83/206* (2013.01); *B65D 83/38* (2013.01); *B65D 83/40* (2013.01)

(58) Field of Classification Search

CPC ..... B65D 83/38; B65D 83/40; B65D 83/205; B65D 83/206

See application file for complete search history.

(56) References Cited

U.S. PATENT DOCUMENTS

| | | | |
|---|---|---|---|
| 3,104,034 | A | 9/1963 | Sagarin et al. |
| 4,511,064 | A | 4/1985 | Ruscitti et al. |
| 7,137,536 | B2 | 11/2006 | Walters et al. |
| 7,246,722 | B2 | 7/2007 | Walters et al. |

(Continued)

FOREIGN PATENT DOCUMENTS

| | | |
|---|---|---|
| JP | 2001088877 | 4/2001 |

OTHER PUBLICATIONS

"Extended European Search Report for EP Application 14832718 dated Feb. 24, 2017".

(Continued)

*Primary Examiner* — J C Jacyna

(57) ABSTRACT

An oversized actuator and actuator assembly for a plastic vessel (or container) configured to hold a product under pressure, such as, for example, a lotion, cream, spray, ointment, gel or foam. The oversized actuator and actuator assembly are configured to be attached to what is considered to be a common, standard-sized valve cup (typically about 1.0 to 1.5 inches across) fastened to a common or standard-sized neck portion for a plastic vessel. Therefore, the actuator and actuator assembly of the present invention does not require that the shoulder of the plastic vessel to which they are attached have specialized geometry molded into the shoulder or body portions of the plastic vessel in order to hold the actuator or actuator assembly in place on the plastic vessel.

5 Claims, 9 Drawing Sheets

(56) References Cited

U.S. PATENT DOCUMENTS

| | | | |
|---|---|---|---|
| 8,434,629 | B2 | 5/2013 | Fernandez |
| 2004/0149781 | A1 | 8/2004 | Kunesh et al. |
| 2007/0235474 | A1 | 10/2007 | Downey et al. |
| 2008/0061087 | A1 | 3/2008 | Reedy et al. |
| 2011/0006083 | A1 | 1/2011 | Walters et al. |
| 2011/0017701 | A1 | 1/2011 | Soliman |
| 2013/0334260 | A1 | 12/2013 | Hermans et al. |
| 2014/0048359 | A1 | 2/2014 | Olkkonen et al. |
| 2016/0145032 | A1 | 5/2016 | Fournet |

OTHER PUBLICATIONS

"International Search Report for PCT/US14/48359 dated Dec. 5, 2014".

"Written Opinion for International Application PCT/US14/48359 dated Dec. 5, 2014".

ACTUATOR ASSEMBLY FOR A PRESSURIZED PLASTIC VESSEL

FIELD OF THE INVENTION

The present invention relates generally to actuators, actuator assemblies and pressurized plastic vessels (or plastic containers) for holding and dispensing formulations under pressure. In particular, the present invention relates to oversized actuators and actuator assemblies for top- and bottom-dispensing pressurized plastic vessels, where the cross-sectional area of the actuator and/or actuator assembly is greater than the cross-sectional area of the valve cup on the neck portion of the plastic vessel.

BACKGROUND OF THE INVENTION

Pressurized metal cans that hold and dispense products under pressure, such as bug spray, paint or deodorant, are well known and widely used across many different industries. Increasingly, pressurized plastic vessels (e.g., bottles made from polyethylene terephthalate, a.k.a. "PET bottles"), rather than pressurized metal cans, are being used to hold and dispense all types of products, including without limitation, aerosols, mists, lotions, ointments, gels and foams. In such cases, it is often necessary or desirable for ergonomic, safety and/or sanitary reasons to attach large or oversized actuators to the pressurized plastic vessels. However, whereas the bodies of metal cans are easily adapted to accept and hold large or oversized actuators while resisting internal pressure, the bodies of pressurized plastic vessels under internal pressure do not have the structural strength and rigidity required to hold and maintain the special geometries necessary for securely attaching, holding, detaching and re-attaching large and oversized actuators. Consequently, the actuators for pressurized plastic vessels are typically attached to the neck portions of the pressurized plastic vessels. As a result, pressurized plastic vessels will typically have relatively small actuators having cross-sectional areas that are roughly the same size or smaller than the valve cup fitted to the neck portions of the plastic vessels. For certain products, such as hair sprays, lotions and sunscreens, or other relatively slippery, foamy or oily substances, these relatively small actuators can be uncomfortable, inconvenient, hard to use and/or hard to keep clean. If the actuator also acts a closure for the plastic vessel, the relatively small actuator makes it difficult, if not impossible, to stand the plastic vessel on a substantially flat surface with the actuating and dispensing end of the plastic vessel in a downward orientation.

Addressing the aforementioned problems by increasing the cross-sectional area of the neck portion of the plastic vessel or increasing the cross-sectional area of the valve cup attached to the neck portion would be cost prohibitive due to the fact that most plastic bottles are blow-molded from blanks having neck portions that are selected from one of a limited number of standard (and smaller) sizes. Thus, plastic vessels with standard-sized neck portions and standard-sized valve cups that fit standard-sized neck portions are relatively plentiful, inexpensive and easy to acquire. However, plastic vessels with very large neck portions, as well as very large valve cups for standard or large plastic vessel neck portions are rare and relatively expensive to purchase or manufacture in large quantities.

Accordingly, there exists a significant need across multiple industries for large and/or oversized actuators that will fit pressurized plastic vessels that have neck portions and corresponding valve cups that are relatively common in size and are, therefore, relatively easy to acquire and/or manufacture in large quantities. There is also a significant need for large and oversized actuators that do not require that the plastic vessel to which they are attached have any special internal pressure-resistant geometry in the shoulder portions of the plastic vessel in order to provide a secure and stable fit for the large or oversized actuators. And there is also a need to address the above-described problems with a solution that minimizes the number of secondary operations required to manufacture, assemble and attach the large or oversized actuators to the plastic vessels.

SUMMARY OF THE INVENTION

In general, embodiments of the present invention provide an oversized actuator and an oversized actuator assembly for a plastic vessel (or container) configured to hold a product under pressure, such as, for example, a lotion, cream, spray, ointment, gel or foam. Notably, the oversized actuator or actuator assembly is configured to be attached to what is considered to be a common, standard-sized valve cup (typically about 1.0 to 1.5 inches across) fastened to a common or standard-sized neck portion for a plastic vessel. Therefore, the actuator and actuator assembly of the present invention does not require that the shoulder of the plastic vessel to which they are attached have specialized geometry molded into the shoulder or body portions of the plastic vessel in order to hold the actuator or actuator assembly in place on the plastic vessel. When activated by a user, the actuator and actuator assembly engage with and open a pressure valve extending from the valve cup attached to the plastic vessel, which permits the product or formulation under pressure to pass out of the plastic vessel through a dispensing nozzle on the actuating surface of the actuator or actuator assembly. In some embodiments, the actuator assembly of the present invention includes a flip-open undercap configured to enable standing the conjoined actuator assembly and plastic vessel in an upright orientation on a substantially-flat surface.

In a first embodiment of the invention, there is provided an oversized actuator assembly, comprising two pieces, the first piece being a unitary piece of molded plastic material, referred to as the actuator body, and the second piece being an adaptor. The adaptor is not necessarily formed from molded plastic material; it may be formed, for example, from metal or ceramic materials, as well as plastic, or some combination of one or more of these materials. In this embodiment, the actuator body piece and the adaptor piece are typically independently manufactured and then permanently joined together by means of a friction fit, an adhesive or other type of mechanical or chemical seal or joint, in order to produce the oversized actuator assembly. Once the actuator body and the adaptor are permanently joined together, the free end of the adaptor may be connected to the valve cup on the neck portion of a pressurized plastic vessel, thereby securely fastening the oversized actuator assembly to the pressurized plastic vessel. Moreover, because the free end of the adaptor is configured to fit a standard-sized valve cup on a standard-sized neck portion of the pressurized plastic vessel, the pressurized plastic vessel does not need to have any special geometry molded into its shoulder or body portions in order to accommodate and securely hold the oversized actuator assembly in place.

The actuator body piece of the oversized actuator assembly comprises a unitary piece of molded plastic material molded to form a plurality of functional components, including an actuating surface, a sidewall, a gap, a bridge, a flip-open undercap and a flexible hinge. The actuating surface has a cross-sectional area that is larger than the cross-sectional area of the valve cup attached to the neck portion of the plastic vessel. In some embodiments, the cross-sectional area of the actuating surface is only slightly larger than the cross-sectional area of the valve cup. In other embodiments, the actuating surface is at least 25% larger than the valve cup cross-sectional area. In still other embodiments, the cross-sectional area of the actuating surface is at least 50% larger than the valve cup cross-sectional area. In still other embodiments, the cross-sectional area of the actuating surface may be larger than the cross-sectional area of valve cup by as much as 75%, 100%, 200%, or more.

The actuating surface also has a valve interface and a dispensing nozzle. The valve interface is configured to face and engage with the pressure valve extending from the valve cup on the plastic vessel. Typically, although not necessarily, the actuating surface will include protrusions, depressions and/or ridges (or some combination thereof) configured to serve as a guide and non-slipping and ergonomic surface for placement of a user's thumb and/or finger(s) during actuation of the actuating assembly.

The actuator body piece of the actuator assembly also includes a sidewall, which supports and surrounds the actuating surface, and a gap, interposed between the outer edge of the actuating surface and the supporting sidewall. The gap may comprise, for example, a slit, cutout, space, void or other opening defining the outer edge of the actuating surface and the inner edge of the supporting sidewall. The actuator body also includes at least one bridge that spans the gap between the actuating surface and the sidewall, thereby connecting a portion of the actuating surface to a section of the sidewall. The arrangement and structure of the actuating surface, the gap and the bridge permit the actuating surface to move relative to the sidewall by pivoting about the axis of the bridge. The movement may be in a vertical, horizontal or rotational direction, relative to the valve cup and the pressure valve, as appropriate for the size, structure and configuration of the valve cup and pressure valve.

In some embodiments, the gap may be filled, covered, shielded or otherwise protected by an elastomeric plastic material, molded into place over or within the slit, cutout, space or void between the outer edge of the actuating surface and the sidewall. The elastomeric material may prevent dirt, foreign objects or particles from passing into the actuator body and/or contaminating the product under pressure inside the plastic vessel. Alternatively, the gap may not filled, covered or shielded by any physical material other than open air. In some implementations, the actuator body may have two or more bridges connecting three or more portions of the actuating surface to three or more sections of the sidewall, so that the actuating surface is permitted to move relative to the sidewall by pivoting, rocking and/or teetering about the axes formed by the at least two or more bridges.

The actuator body piece further includes a flip-open undercap having a base wall configured to permit the actuator assembly and the plastic vessel to stand upright on a substantially flat supporting surface while the actuator assembly and the plastic vessel are fastened together. At least one flexible hinge on the actuator body movably connects the flip-open undercap to the sidewall and permits the flip-open undercap to pivot between an open position away from the actuating surface and a closed position adjacent to the actuating surface. For bottom-dispensing plastic vessels, the flip-open undercap permits the plastic vessel and actuator assembly to stand upright on the substantially flat surface with the actuator surface end oriented in the downward direction.

The adaptor piece of the actuator assembly may be constructed from any one of a variety of different materials, including without limitation, metal, ceramic or plastic, or some combination thereof. The adaptor piece comprises a valve cup interface having at least one wall (e.g., a vertically-oriented wall) positioned and configured to stabilize the horizontal position of actuator body relative to the valve cup, and at least one other wall (e.g., a horizontally-oriented wall) positioned and configured to stabilize the vertical position of actuator body relative to the valve cup. One or both of these vertical and horizontal walls on the valve cup interface may be further adapted to form a frictional fit with one or more outer surfaces of the valve cup. The adaptor piece further includes a flange, extending outwardly from the at least one wall of the valve cup interface, the flange being arranged to form a frictional fit with the sidewall on the actuator body piece. Alternatively, the valve cup interface and the flange on the adaptor piece may include geometric structures configured to permit the valve cup interface to snap onto the valve cup and the flange to snap into the sidewall of the actuator body. The valve cup interface and the flange on the adaptor piece may also include threads configured to engage with corresponding threads, respectively, on an outer wall of the valve cup and an inner surface of the sidewall on the actuator body piece.

The adaptor piece of the actuator assembly, which is manufactured separately and then joined to the actuator body, is configured to securely fasten the actuator body piece to the valve cup on the plastic vessel so that activating the actuating surface by, for example, using one's thumb or forefinger to depress the protrusions, depressions and/or ridges on the actuating surface, will cause the actuating surface to move and/or pivot about the bridge so that the valve interface on the actuating surface will engage with and open the pressure valve extending from the valve cup attached to the neck portion of the plastic vessel. Opening the pressure valve in this manner permits the product under pressure to pass out of the plastic vessel through the dispensing nozzle on the actuating surface.

The sidewall on the actuator body is configured to put space or clearance between the adaptor and the actuating surface so that the actuating surface can move, relative to the adaptor and valve cup, and the dispensing nozzle on the actuating surface sits relatively close to the outlet of the pressure valve. In some implementations, the sidewall on the actuator body is configured to extend from the gap and over and past the flange to form a continuation of the geometric shape of the shoulder portion of the plastic vessel, thereby entirely concealing the adaptor from view after the actuator assembly is securely fastened to the valve cup by the adaptor piece. In other implementations, the sidewall does not extend past the flange on the adaptor piece, but the adaptor piece includes a skirt, extending from the flange so as to form a continuation of the geometric shape of the shoulder portion of the plastic vessel, which may be desirable for cosmetic reasons or necessary for sanitary reasons. In still other implementations, the sidewall does not extend all the way around the perimeter of the actuating surface, and comprises only a relatively narrow structure connecting the actuating surface to the adaptor. In this configuration, for example, the sidewall may be no broader than the breadth of the bridge, thereby exposing a substantial portion of the valve cup and adaptor underneath the actuating surface to view from the outside. In still other implementations, the sidewall may comprise a plurality of ribs or spires and holes, connected to the adaptor and the bridge, which operate to impose the necessary vertical clearance between the valve cup and the actuator surface.

The actuating surface, sidewall, gap, bridge, flexible hinge and flip-open undercap of the actuator body are all formed from a unitary piece of molded plastic material in accordance with well-known injection-molding techniques. Typically, this will involve injection-molding the actuator body piece with the undercap in the open position (i.e., rotated away from the actuating surface) in order to facilitate arrangement of the steel mold walls to accommodate formation of both the top and bottom of the actuating surface and the top and bottom of the rest of the actuator body. The adaptor piece is separately constructed from a second piece of molded plastic or other material, and then joined with the actuator body piece in order to create the actuator assembly prior to attachment to the plastic vessel.

In a second embodiment of the invention, a one-piece oversized actuator for a pressurized plastic vessel is provided. In this embodiment, all of the functional components of the actuator, including the actuating surface and the adaptor, are built into the same unitary piece of molded plastic material. Therefore, there is no separate second piece in this embodiment of the invention and no assembly is required before connecting the oversized actuator to the plastic vessel. As in the two-piece oversized actuator assembly version of the invention, the free end of the adaptor component of the one-piece oversized actuator also attaches to the valve cup on the neck portion of the pressurized plastic vessel, and the shoulder and body portions of the pressurized plastic vessel do not require any special geometry to hold the oversized actuator in place.

In the one-piece actuator version of invention, the actuator comprises a single piece of molded plastic material molded to include the actuator surface, sidewall, gap, adaptor and flexible hinge. The actuator surface is connected to the sidewall and/or the adaptor by the flexible hinge, the flexible hinge being configured to accommodate rotating the actuator surface over the adaptor to click or lock the actuating surface into place adjacent to the adaptor after the unitary piece comes out of the mold.

The one-piece oversized actuator includes an actuating surface with a valve interface and a dispensing nozzle. The actuator further includes a sidewall and at least one flexible hinge that movably connects the actuating surface to the sidewall. The flexible hinge permits the actuating surface to move relative to the sidewall by pivoting, rocking or teetering about the axes of the flexible hinge. The movement may be in a vertical, horizontal or rotational direction, relative to the valve cup and the pressure valve, as appropriate for the size, structure and configuration of the valve cup and pressure valve.

In the one-piece version of the present invention, like the two-piece version, the cross-sectional area of the actuating surface is larger than the cross-sectional area of the valve cup. Thus, the cross-sectional area of the actuating surface could be slightly larger than the cross-sectional area of the valve cup, at least 25% larger than the cross-sectional area of the valve cup, at least 50% larger than the cross-sectional area of the valve cup, or at least 75%, 100% or 200% larger than the cross-sectional area of the valve cup, depending on the type and geometry of the plastic vessel used.

In the one-piece oversized actuator version of the present invention, a separately molded flip-open undercap may be configured to snap onto the actuator body so that it covers the actuator surface when not in use. The flip-open undercap may include a base wall configured to permit the actuator assembly and the plastic vessel to stand upright on a substantially flat supporting surface while the actuator assembly and the plastic vessel are fastened together.

Just like the adaptor in the two-piece actuator assembly, the free end of adaptor component of the one-piece oversized actuator version of the present invention includes a valve cup interface configured to securely fasten the actuator to the valve cup on the plastic vessel. The valve cup interface may be configured to snap or screw onto the valve cup. Unlike in the first implementation, at least one flexible hinge movably connects the sidewall of the actuator body to the adaptor, thereby permitting the actuator body to pivot from an open position away from the adaptor to a closed position adjacent to the adaptor. When the actuator body is in the closed position, the valve interface on the actuating surface is positioned near the pressure valve on the plastic vessel so that activating the actuating surface on the actuator body will cause the valve interface to engage with and open the pressure valve on the plastic vessel. Therefore, operating the actuating surface permits the product under pressure to pass out of the plastic vessel through the dispensing nozzle on the actuating surface.

In a third embodiment of the invention, a container for a product under pressure is provided, the container including a plastic vessel, a valve cup connected to the neck portion of the plastic vessel, an oversized actuator body, and an adaptor that connects the oversized actuator body to the valve cup on the plastic vessel. As in the first two embodiments, the free end of the adaptor connects the actuator body to the valve cup on the neck portion of the plastic vessel. Hence, no special geometry is required on the shoulder portion of the plastic vessel in order to hold the oversized actuator body in place on the plastic vessel.

In addition to the plastic vessel, the container includes a valve cup fastened to the neck portion of the plastic vessel, a pressure valve extending from the valve cup, an actuator body and an adaptor. The adaptor is configured to fasten the actuator body to the valve cup so that activating the actuating surface will cause the valve interface to open the pressure valve on the plastic vessel to permit the product under pressure to pass out of the plastic vessel through the dispensing nozzle.

The actuator body for the container comprises a unitary piece of molded plastic material, the unitary piece of molded plastic material comprising an actuating surface having a cross-sectional area that is larger than the valve cup cross-sectional area, the actuating surface further having an outer edge, a valve interface and a dispensing nozzle. The actuating body also includes a sidewall, a gap separating the sidewall from the outer edge of the actuating surface, at least one bridge spanning the gap between the actuating surface and the sidewall, the bridge connecting a portion of the actuating surface to a section of the sidewall so that the actuating surface is permitted to move relative to the sidewall by pivoting about the bridge. The actuator body also includes a flip-open undercap having a base wall configured to permit the actuator assembly and the plastic vessel to stand upright on a substantially flat supporting surface while the actuator body and the plastic vessel are fastened together. At least one flexible hinge movably connects the flip-open undercap to the sidewall and permits the flip-open undercap to pivot between an open position away from the actuating surface and a closed position adjacent to the actuating surface. Preferably, but not necessarily, the plastic vessel has a shoulder portion adjacent to the neck portion, the shoulder portion having a geometric shape and cross-sectional area that is also larger than the valve cup cross-sectional area, and the sidewall on the actuator body is configured to form a continuation of the geometric shape of the shoulder portion of the plastic vessel.

In all three of the embodiments of the invention described above, the actuator body comprises a unitary piece of molded plastic material. In the one-piece oversized actuator, the unitary piece of molded plastic material is specifically molded to provide several features, including the actuator surface, the sidewall, the adaptor and the flexible hinge. In this version, the flexible hinge (also called a "living hinge") provides the fulcrum by which the actuating surface may be rotated and locked into a permanent position above the adaptor after the actuator is removed from the mold. In the two-piece actuator assembly, the actuator body is a unitary piece of molded plastic material specifically molded to provide the actuating surface, the gap, the sidewall, the bridge, the flip-open undercap and the flexible hinge. In this version, however, the flexible hinge provides the fulcrum by which the flip-open undercap may be temporarily rotated into a closed position over the actuating surface to protect the actuating surface and the dispensing nozzle when the device is not being used. Thus, in the one-piece actuator version of the invention, the unitary piece of molded plastic material includes the adaptor component and excludes the flip-open undercap component. In the two-piece actuator assembly version of the invention, however, the unitary piece of molded plastic excludes the adaptor component and includes the flip-open undercap component. In both the actuator and actuator assembly versions, the flexible (living) hinge is an included component of the unitary piece of molded plastic material, albeit to connect different parts and to serve different purposes.

Molding all of the components of the actuator body from a unitary piece of molded plastic material, instead of producing each component from separate pieces serves important objectives of minimizing the number of secondary operations that must be carried out after the oversize actuator and oversized actuator assembly are made, and reduces the overall time and cost associated with producing a final product for market. In the one-piece actuator version, when the actuator body is removed from the mold, one only needs to rotate the actuating surface into place atop the sidewall before attaching the actuating body to the valve cup on the pressurized plastic vessel. In the two-piece actuator assembly version, one only needs to attach the actuator body to the adaptor to complete the actuator assembly, and then attach the actuator assembly to the valve cup on the pressurized plastic vessel. If the actuator and actuator assembly required joining together three, four, five or more separately-manufactured pieces of material, a corresponding number of additional secondary operations would have to be added to the manufacturing process in order to join all of those pieces of material together, thereby increasing the cost, time and machinery needed to produce the final product.

In addition, because the actuating surface is constructed from a unitary piece of molded plastic material instead of a multiplicity of abutting parts, and because the actuating surface is relatively large compared to prior art actuating surfaces for pressurized plastic bottles, the actuating surface in the present invention is relatively easy to wipe clean and keep sanitary during normal use by a consumer.

The foregoing has outlined rather broadly the more pertinent features of the present invention in order that the detailed description that follows may be better understood and the present contribution to the art can be more fully appreciated. Additional features and details of the invention, which also illustrate the subject matter of the invention, will be described hereinafter. It should be appreciated by those skilled in the art that the conception and specific embodiments and implementations may be readily used as a basis for modifying or designing other structures for carrying out the same purposes of the present invention. It should also be realized by those skilled in the art that such equivalent constructions do not depart from the spirit and scope of the present invention.

BRIEF DESCRIPTION OF THE DRAWINGS

Exemplary and therefore non-limiting embodiments and variations of the present invention, and various aspects, features and advantages thereof, are explained in more detail below with reference to and with the aid of the drawings, all of which constitute a part of this specification and include depictions of the exemplary embodiments. In these drawings.

Similar reference numbers and characters refer to similar parts throughout the several figures of the drawings.

DETAILED DISCUSSION OF EXEMPLARY EMBODIMENTS

Figure 1A:
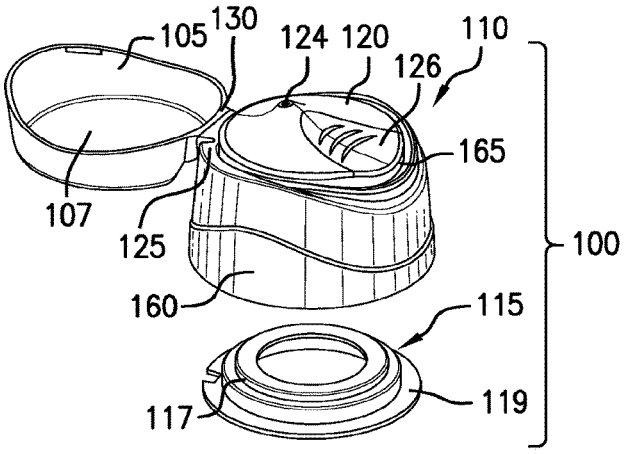
FIGS. 1A, 1B and 1C show, respectively, a front-left perspective view, a rear-left perspective view, and a top-left perspective view of a two-piece oversized actuator assembly, in accordance with an exemplary embodiment of the present invention, with the flip-open undercap in the open position.
Figure 1B:
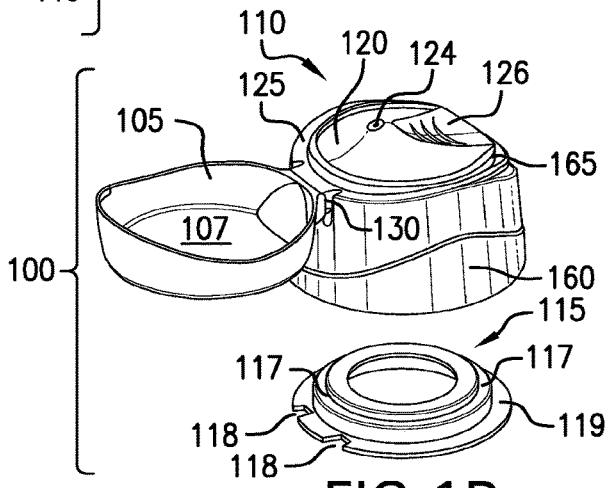
Figure 1C:
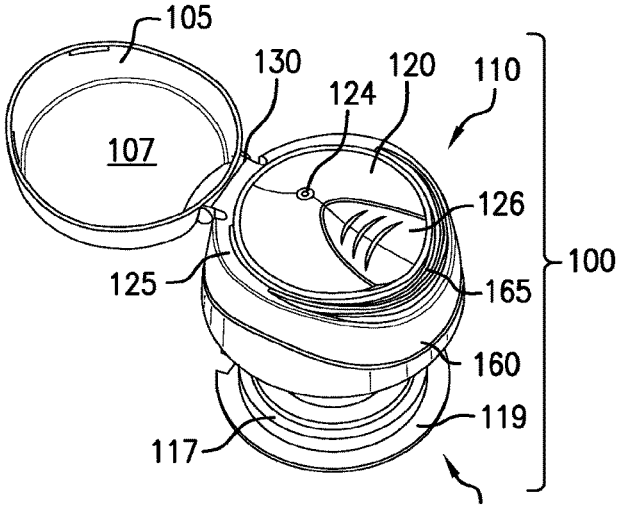
Figure 2A:
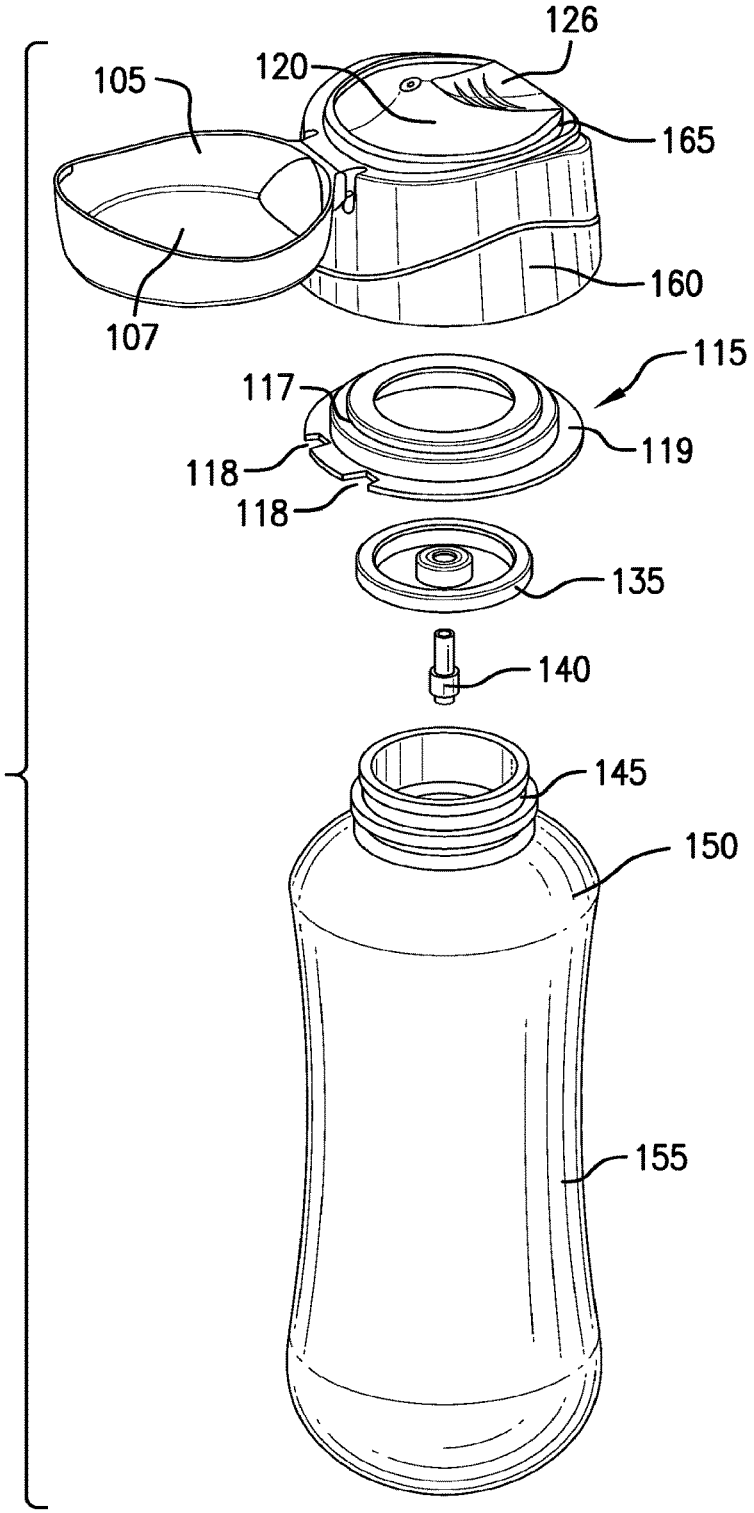
FIGS. 2A and 2B show exploded views of the oversized actuator assembly, in accordance with the present invention, as seen from a rear-left perspective and a front-left perspective, respectively, and illustrate the relative sizes and positions of the actuator assembly components in relation to an exemplary valve cup, pressure valve and pressurized plastic vessel.
Figure 2B:
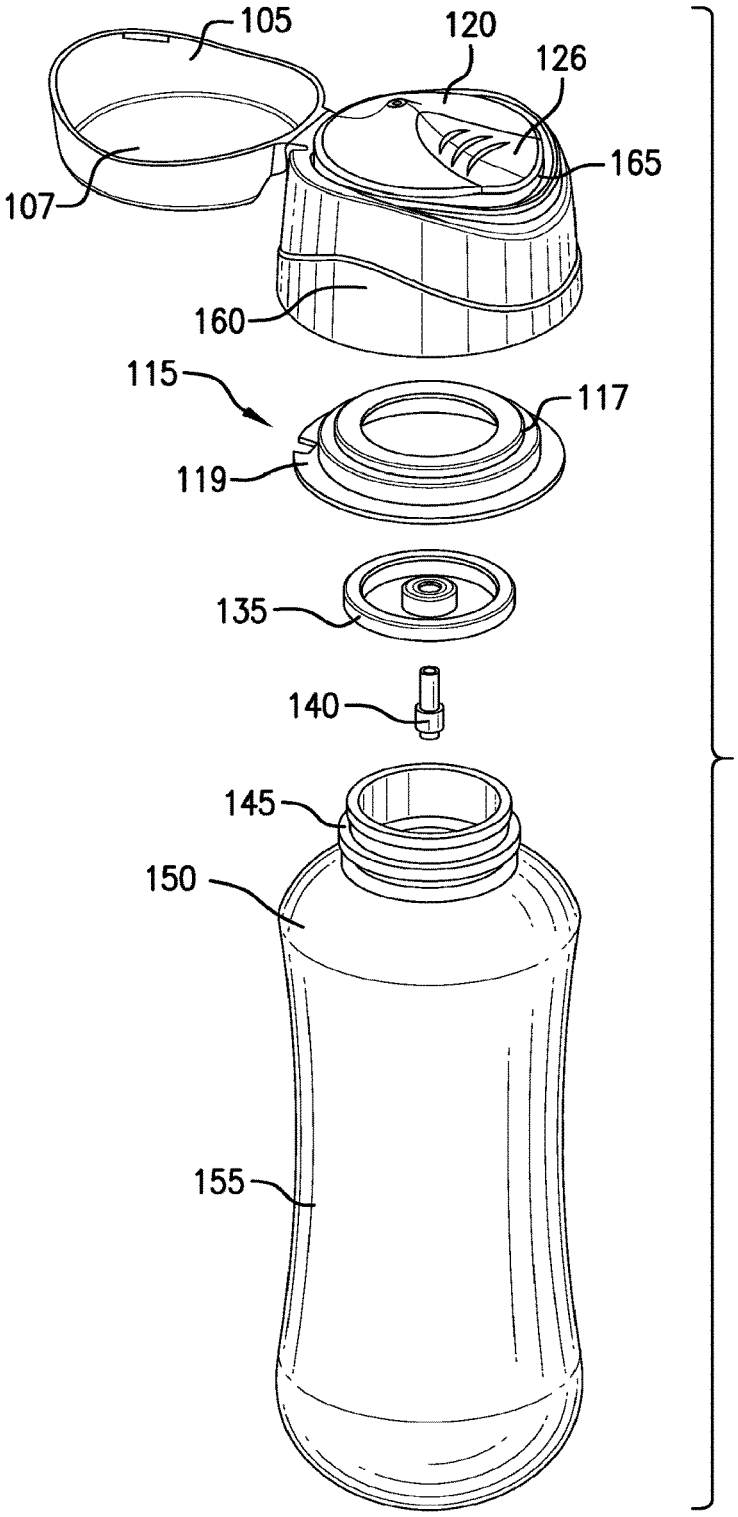
Figure 3A:
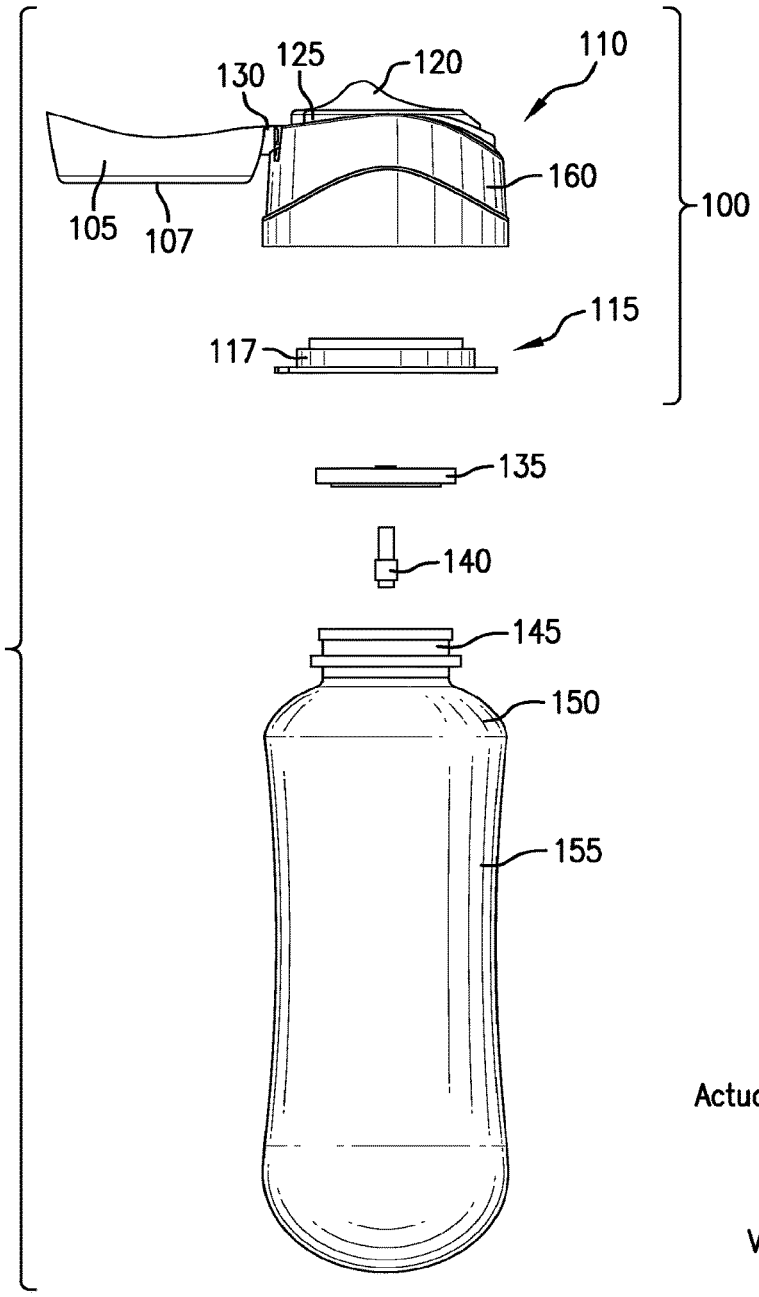
FIG. 3A shows is a left side exploded view of the actuator assembly, in accordance with an embodiment of the present invention, and illustrates the relative sizes and positions of the actuator assembly components in relation to an exemplary valve cup, pressure valve and pressurized plastic vessel.
Figure 4:
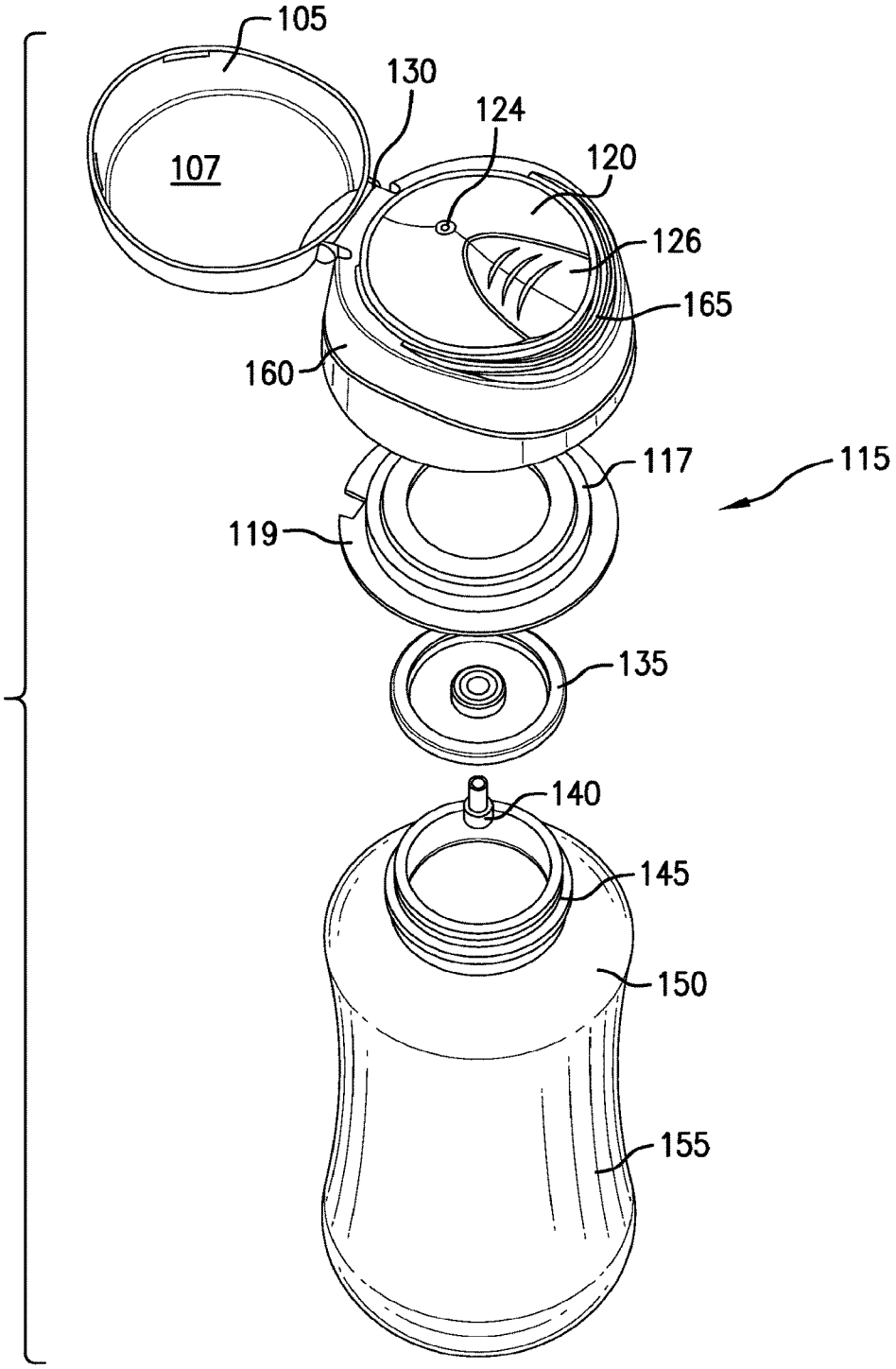
FIG. 4 shows a top-left perspective exploded view of the actuator assembly, in accordance with an exemplary embodiment of the present invention, and illustrates the relative sizes and positions of the actuator assembly components in relation to an exemplary valve cup, pressure valve and pressurized plastic vessel.

FIGS. 1A, 1B and 1C show, respectively, a front-left perspective view, a rear-left perspective view, and a top-left perspective view of an two-piece oversized actuator assembly 100, in accordance with an exemplary embodiment of the present invention, with the flip-open undercap 105 in the open position. FIGS. 2A and 2B show exploded views of the two-piece oversized actuator assembly 100, along with the valve cap 135, pressure valve 140 and plastic vessel 155, as seen from a rear-left perspective and a front-left perspective, respectively. Thus, FIGS. 2A and 2B illustrate the relative sizes and positions of the components of the actuator assembly 100 in relation to a typical valve cup 135, pressure valve 140 and pressurized plastic vessel 155. FIG. 3A shows is a left side exploded view of the two-piece actuator assembly 100 further illustrating the relative positions of the actuator body 110, adaptor 115, valve cup 135, pressure valve 140 (also known as a valve stem) and plastic vessel 155. FIG. 4 shows a top-left perspective exploded view of the actuator assembly, in accordance with an exemplary embodiment of the present invention, and illustrates the relative sizes and positions of the actuator assembly components in relation to an exemplary valve cup, pressure valve and pressurized plastic vessel.

As shown in FIGS. 1A-1C, 2A, 2B, 3A, 3B and 4, actuator assembly 100 includes two individual pieces, including an actuator body 110, comprising a unitary piece of molded plastic material, and an adaptor 115. The actuator body 110 is typically created in an injection-molding step, using methods and techniques well-known in the art, to form a single piece of molded plastic material having a number of features, including a flip-open undercap 105 in the open position, an actuating surface 120, a gap 165, a bridge 125, and a flexible hinge 130. As shown best in FIGS. 2A, 2B, 3A, 3B and 4, the actuating surface 120 on the actuator body 110 has a size (when measured by its cross-sectional area) that is larger than the cross-sectional area of the valve cup 135 attached to the neck portion 145 of the plastic vessel 155. Thus, if the actuator surface 120 and the valve cup 135 both have substantially circular cross sections, as illustrated in the figures, then the diameter of the actuator surface 120 will be longer than the diameter of the valve cup 135. It should be understood, however, that the actuator body 110, actuator surface 120, adaptor 115, valve cup 135 and plastic vessel 155 do not necessarily have circular-shaped cross sections. Any one of these components (or all of them) may have a cross sectional shape that comprises any other shape that would be suitable or desirable, including without limitation, an ellipse, an oval, a rectangle, a square or a triangle, to name a few.

Figure 3B:
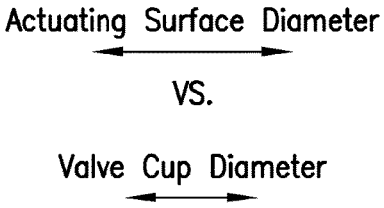
FIG. 3B illustrates, by way of example, the relative sizes of the diameter of the actuating surface and the diameter of the valve cup in the exemplary embodiment shown in FIG. 3A.

FIG. 3B illustrates, by way of example, the relative sizes of the diameter of the actuating surface and the diameter of the valve cup in the exemplary embodiment shown in FIG. 3A. As shown in FIG. 3B, the diameter of the actuating surface 120 is larger than the diameter of the valve cup 135. Therefore, the cross-sectional area of the actuating surface is larger than the cross-sectional area of the valve cup. In some embodiments, the cross-sectional area of the actuating surface 120 may be only slightly larger than the cross-sectional area of the valve cup 135. In other embodiments, the actuating surface is at least 25% larger than the valve cup cross-sectional area. In still other embodiments, the cross-sectional area of the actuating surface is at least 50% larger than the valve cup cross-sectional area. In still other embodiments, the cross-sectional area of the actuating surface may be larger than the cross-sectional area of valve cup by as much as 75%, 100%, 200%, or more.

The actuator body 110 also includes a sidewall 160, which supports and surrounds the actuating surface 120, and a gap 165, interposed between the outer edge of the actuating surface 120 and the supporting sidewall 160. The gap 165 may comprise, for example, a slit, cutout, space, void or other opening defining the outer edge of the actuating surface 120 and the inner edge of the supporting sidewall 160. At least one bridge 125 spans the gap 165 between the actuating surface 120 and the sidewall 160, thereby connecting a portion of the actuating surface 120 to a section of the sidewall 160. The arrangement and structure of the actuating surface 120, the gap 165 and the bridge 125 permit the actuating surface 120 to move relative to the sidewall 160 by pivoting about the axis of the bridge 125. The movement may be in a vertical, horizontal or rotational direction, relative to the valve cup 135 and the pressure valve 140, depending, for example, on the size, structure and configuration of the valve cup 135 and pressure valve 140. In some embodiments, the gap 165 may be filled, covered, shielded or otherwise protected by an elastomeric plastic material (not shown in the figures), molded into place over, within or underneath the gap 165. The elastomeric material may be desired in order to prevent dirt and other foreign objects or particles from passing into the actuator body 110, damaging the actuator assembly 100 and contaminating the product under pressure inside the plastic vessel 155. Notably, the gap 165 also may not be filled, covered or shielded by any physical material other than open air. In some implementations, the actuator body 110 may have at least two bridges (not shown) connecting at least two portions of the actuating surface 120 to at least two sections of the sidewall 160, so that the actuating surface 120 call move relative to the sidewall 160 by pivoting, rocking and/or teetering about the two axes formed by the bridges.

As previously stated, the actuator body 110 further includes a flip-open undercap 105 having a base wall 107 configured to permit the actuator assembly 100 and the plastic vessel 155 to stand upright on a substantially flat supporting surface (not shown) while the actuator assembly 100 and the plastic vessel 155 are joined or fastened together. A flexible hinge 130 movably connects the flip-open undercap 105 to the sidewall 160 on the actuator body 110 and permits the flip-open undercap 105 to pivot between an open position away from the actuating surface 120 and a closed position adjacent to the actuating surface 120. For bottom-dispensing plastic vessels, the flip-open undercap 105 permits the plastic vessel 155 and actuator assembly 100 to stand upright on a substantially flat surface (not shown) with the dispensing end of the plastic vessel 155 oriented in the downward direction. See FIG. 5B.

Figure 5A:
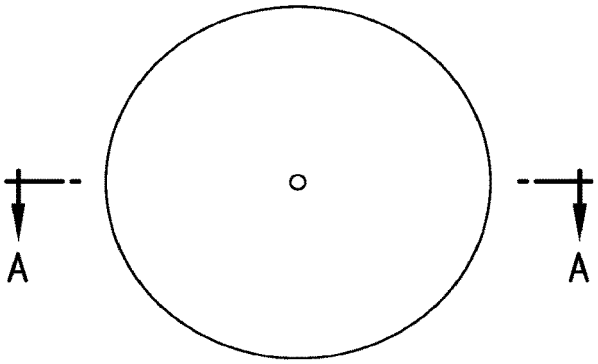
FIG. 5A shows a top view of an exemplary embodiment of an actuator assembly attached to a bottom-dispensing pressurized plastic vessel, in accordance with the present invention, in which the flip-open undercap is closed and the dispensing end of the plastic vessel is oriented in the downward direction.
Figure 5B:
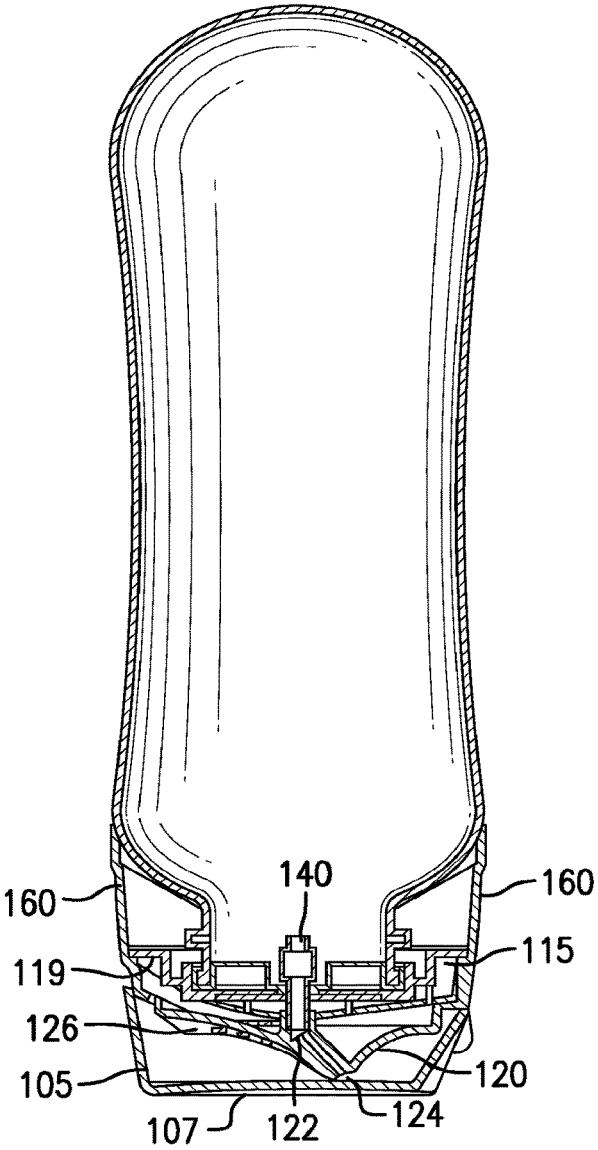
FIG. 5B is a sectional view of the actuator assembly and pressurized plastic vessel along line A-A of the device shown in FIG. 5A.

FIG. 5A shows a top view of an exemplary embodiment of an actuator assembly attached to a bottom-dispensing pressurized plastic vessel, in accordance with the present invention, in which the flip-open undercap is closed and the dispensing end of the plastic vessel is oriented in the downward direction. FIG. 5B is a sectional view of the actuator assembly 100 and pressurized plastic vessel 155 along line A-A of the actuator assembly 100 and pressurized plastic vessel 155 shown in FIG. 5A. As shown in FIG. 5B, the actuating surface 120 also has a valve interface 122 and a dispensing nozzle 124. The valve interface 122 is configured to face and engage with the pressure valve 140 extending from the valve cup 135 on the plastic vessel 155 when the actuating surface 120 is actuated. Note that the valve interface 122 for the two-piece actuator assembly, which is shown in FIG. 5B, may be molded to form substantially the same structure as the valve interface 620 for the one-piece actuator shown in FIGS. 6A and 6B. To facilitate using and handling the actuator and pressurized plastic vessel 155, the actuating surface 120 preferably includes protrusions, depressions and/or ridges 126 (or some combination thereof), which act as a guide and non-slipping and ergonomic surface for placement of a user's thumb and/or finger(s) during actuation of the actuating assembly 100.

In the two-piece version of the actuator assembly 100, the adaptor 115 is configured to securely fasten the actuator body 110 to the valve cup 135 on the plastic vessel 155 so that activating the actuating surface 120 by, for example, using one's thumb or forefinger to depress the protrusions, depressions and/or ridges 126 on the actuating surface 120, will cause the actuating surface 120 to move and/or pivot about the bridge 125 so that the valve interface 122 (see FIGS. 5B, 6A and 6B) on the actuating surface 120 will engage with and open the pressure valve 140 extending from the valve cup 135 attached to the neck portion 145 of the plastic vessel 155. Opening the pressure valve 140 in this manner permits the product under pressure to pass out of the plastic vessel 155 through the pressure valve 140 and the dispensing nozzle 124 on the actuating surface 120.

The adaptor 115 may be constructed from any one of a variety of different materials, including without limitation, metal, ceramic or plastic, or some combination thereof. The adaptor 115 comprises a valve cup interface 117 having at least one wall (e.g., a vertically-oriented wall) positioned and configured to stabilize the horizontal position of actuator body relative to the valve cup 135, and at least one other wall (e.g., a horizontally-oriented wall) positioned and configured to stabilize the vertical position of actuator body relative to the valve cup 135. One or both of these vertical and horizontal walls on the valve cup interface 117 may be further adapted to form a frictional fit with one or more outer surfaces of the valve cup 135. The adaptor 115 further includes a flange 119, extending outwardly from the at least one wall of the valve cup interface 117. The flange 119 is arranged to form a frictional fit with the sidewall 160 on the actuator body piece 110. Alternatively, the valve cup interface 117 and the flange 119 on the adaptor 115 may include geometric structures configured to permit the valve cup interface 117 to snap onto the valve cup 135 and the flange 119 to snap into the sidewall 160 of the actuator body 110. The valve cup interface 117 and the flange 119 on the adaptor 115 may also include threads configured to engage with corresponding threads, respectively, on an outer wall of the valve cup and an inner surface of the sidewall 160 on the actuator body 110. In some embodiments, and as shown best in FIGS. 1B and 2A, the flange 119 may include one or more notches 118 configured to provide the clearance necessary for the pivoting and operation of the flexible hinge 130.

The sidewall 160 is configured to put space between the adaptor 115 and the actuating surface 120 so that the actuating surface 120 can move, relative to the adaptor 115 and valve cup 135, and the dispensing nozzle 124 on the actuating surface 120 sits relatively close to the outlet of the pressure valve 140 after assembly. In some implementations, the sidewall 160 on the actuator body 110 is configured to extend from the gap 165 past the flange 119 to form a continuation of the geometric shape of the shoulder portion 150 of the plastic vessel 155, thereby entirely concealing the adaptor 115 from view after the actuator assembly 100 is securely fastened to the valve cup 135 by the adaptor 115. In other implementations, the sidewall 160 does not extend past the flange 119 on the adaptor 115, but the adaptor 115 includes a skirt extending from the flange 119 so as to form a continuation of the geometric shape of the shoulder portion 150 of the plastic vessel 155, which may be desirable for cosmetic reasons or necessary for sanitary reasons.

For certain applications, the flip open undercap may not be necessary or desirable. For these applications, an oversized actuator may be produced, in accordance with an embodiment of the present invention, wherein the unitary piece of molded plastic incorporates a flexible hinge that attaches the actuating surface (instead of a flip-open undercap) to the sidewall and the adapter. An advantage of this arrangement is that the hinged actuator surface can be rotated 180° during molding so as to move it out of the way to permit all of the features along the tops and bottoms of the actuating surface, the hinge, the sidewall and adaptor to be molded from a unitary piece of plastic material in single injection molding step in order to produce a one-piece oversized actuator for a pressurized plastic vessel.

Figure 6A:
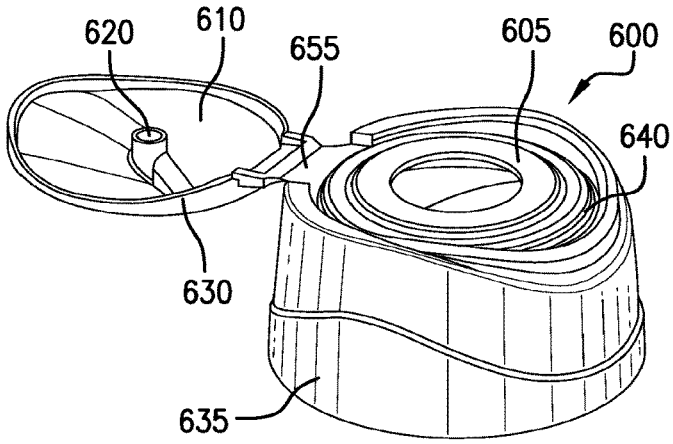
FIGS. 6A, 6B and 6C show, respectively, a front-left perspective view, a rear-left perspective view, and a top-left perspective view of a one-piece oversized actuator, in accordance with another exemplary embodiment of the present invention.
Figure 6B:
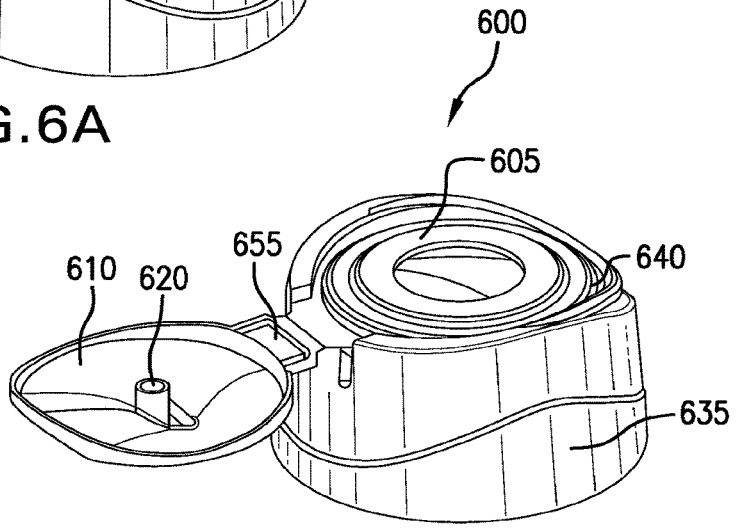
Figure 6C:
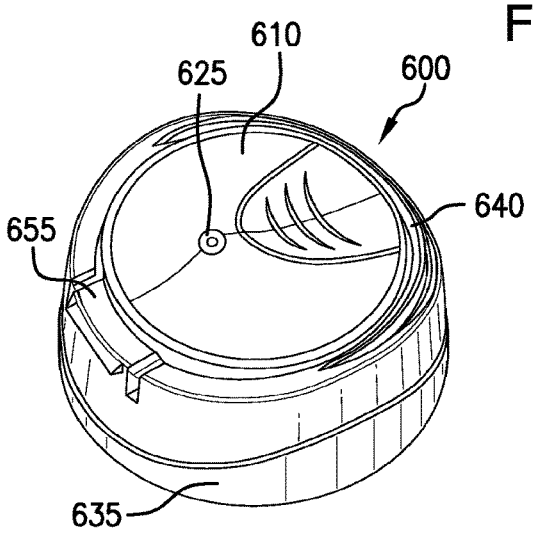
Figure 7A:
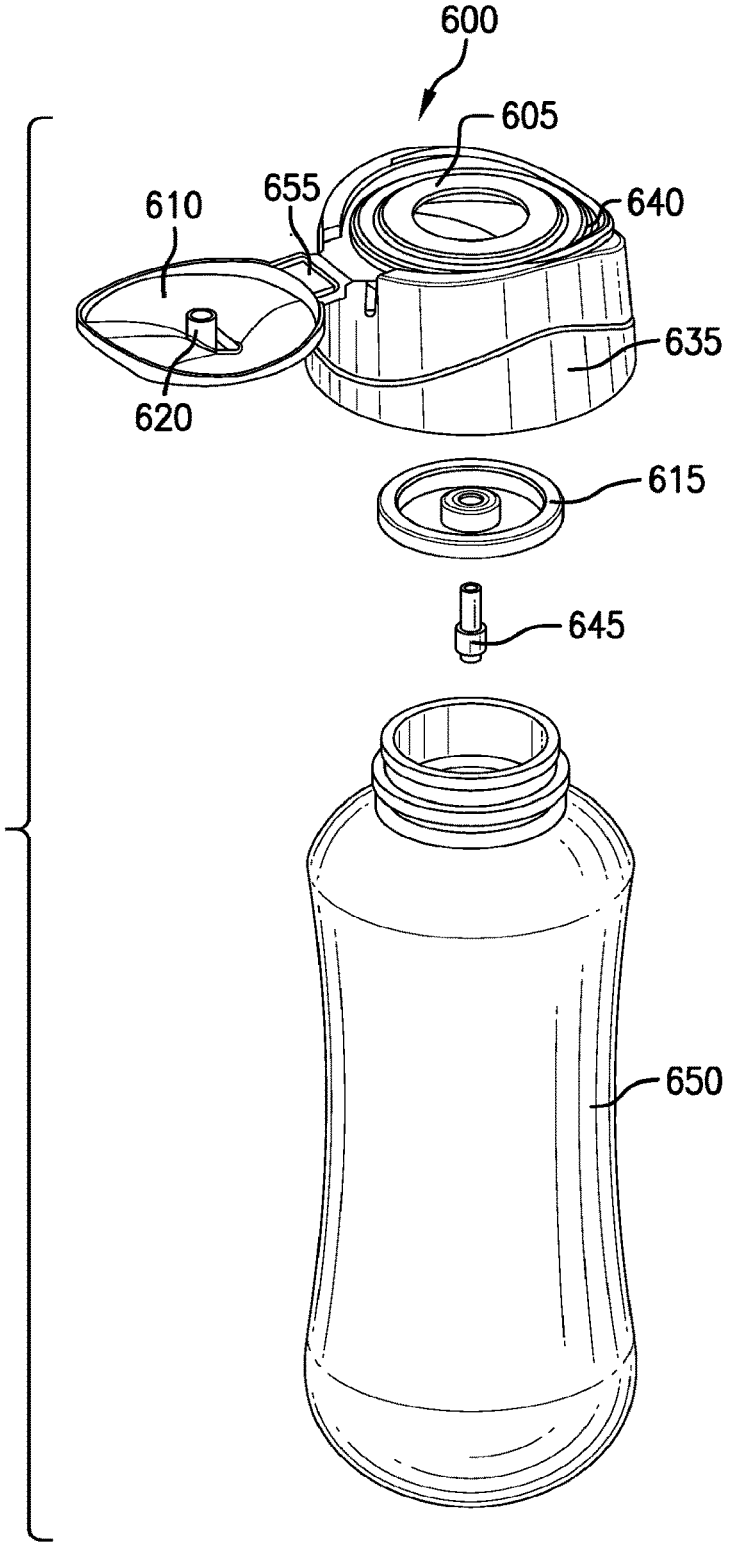
FIGS. 7A and 7B show exploded views of the one-piece oversized actuator, in accordance with an exemplary embodiment of the present invention, as seen from a rear-left perspective and a front-left perspective, respectively, and illustrate the relative sizes and positions of the oversize actuator components in relation to an exemplary valve cup, pressure valve and pressurized plastic vessel.
Figure 7B:
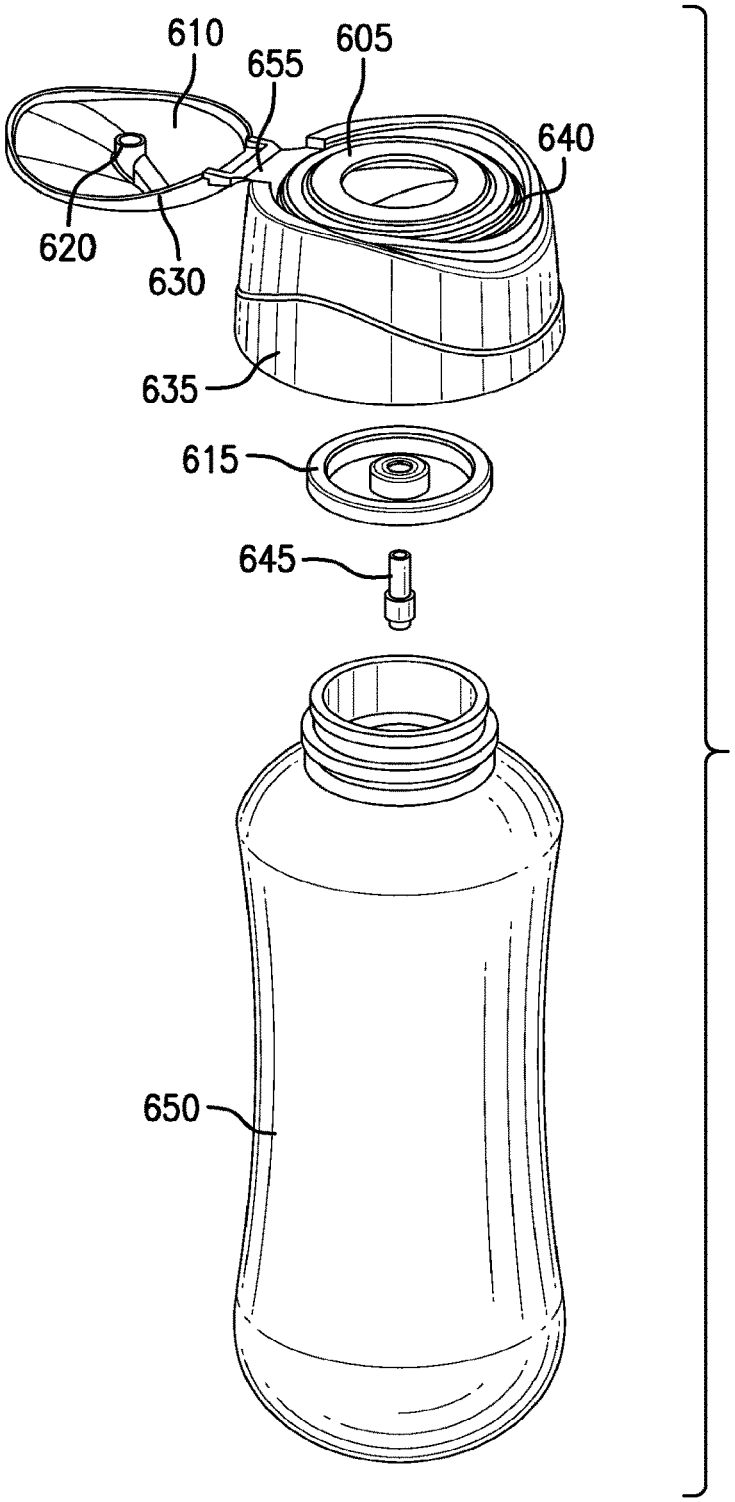

FIGS. 6A, 6B and 6C show, respectively, a front-left perspective view, a rear-left perspective view, and a top-left perspective view of a one-piece oversized actuator 600 for a pressurized plastic vessel configured in accordance with an exemplary embodiment of the present invention. FIGS. 7A and 7B show exploded views of the one-piece oversized actuator 600 as would be seen from a rear-left perspective and a front-left perspective, respectively, and illustrate the relative sizes and positions of the one-piece oversized actuator in relation to the valve cup 615, the pressure valve 645 and the pressurized plastic vessel 650. As shown best in FIGS. 6A and 6B, the one-piece actuator 600 includes an actuator surface 610, connected by a flexible hinge 655 to a sidewall 635 and an adaptor 605, all of which are molded and constructed together from a unitary piece of molded plastic material during an injection molding step. The actuating surface 610 has an outer edge 630 and a cross-sectional area that is larger than the cross-sectional area of the valve cup 615 (the difference in size is shown best in FIGS. 7A and 7B).

The actuating surface 610 on the one-piece actuator 600 includes a valve interface 620, which engages the pressure valve 645 when the actuating surface 610 is activated, thereby opening the pressure valve 645 to permit the product under pressure (not shown in the figures) to exit the plastic vessel 650 through a dispensing nozzle 625 in the actuating surface 610. The one-piece actuator 600 further includes at least one flexible hinge 655 that connects a portion of the actuating surface 610 to a section of the sidewall 635. The flexible hinge 655 acts as a fulcrum and permits the actuating surface 610 to move relative to the sidewall 635 by pivoting, rocking or teetering about the axes of the flexible hinge 655. The movement may be in a vertical, horizontal or rotational direction, relative to the valve cup 615 and the pressure valve 645, as appropriate for the size, structure and configuration of the valve cup 615 and pressure valve 645.

Although the exemplary embodiments, uses and advantages of the invention have been disclosed above with a certain degree of particularity, it will be apparent to those skilled in the art upon consideration of this specification and practice of the invention as disclosed herein that alterations and modifications can be made without departing from the spirit or the scope of the invention, which are intended to be limited only by the following claims and equivalents thereof. It should be understood by those skilled in the art, for example, that although the figures and descriptions above show embodiments in which the oversized actuator assembly a substantially cylindrical, alternative embodiments of the actuator assembly having different geometric shapes are also intended to fall within the scope of the invention.

What is claimed is:

1. A container for a product under pressure, comprising:

a plastic vessel having a neck portion;

a valve cup fastened to the neck portion, the valve cup having a valve cup cross-sectional area, a pressure valve extending from the valve cup;

an actuator body comprising a unitary piece of molded plastic material, the unitary piece of molded plastic material forming an actuating surface having an actuating surface cross-sectional area that is larger than the valve cup cross-sectional area, the actuating surface further having an outer edge, a valve interface and a dispensing nozzle, a sidewall;

a gap separating the sidewall from the outer edge of the actuating surface;

at least one bridge spanning the gap between the actuating surface and the sidewall, said at least one bridge connecting a portion of the actuating surface to a section of the sidewall, wherein the actuating surface is permitted to move relative to the sidewall by pivoting about the bridge;

a flip-open undercap having a base wall configured to permit the actuator and the plastic vessel to stand upright on a substantially flat supporting surface while the actuator body and the plastic vessel are fastened together, and at least one flexible hinge that movably connects the flip-open undercap to the sidewall and permits the flip-open undercap to pivot between an open position away from the actuating surface and a closed position adjacent to the actuating surface; and an adaptor configured to fasten the actuator body to the valve cup so that activating the actuating surface will cause the valve interface to open the pressure valve on the plastic vessel to permit the product under pressure to pass out of the plastic vessel through the dispensing nozzle, wherein the adaptor comprises:

a valve cup interface having at least one wall configured to form a frictional fit with an outer surface of the valve cup; and a flange extending outwardly from said at least one wall of the valve cup interface, the flange being arranged to form a second frictional fit with the sidewall.

2. The container of claim 1, wherein the gap comprises an elastomeric plastic material.

3. The container of claim 1, wherein the actuating surface cross-sectional area is at least 50% larger than the valve cup cross-sectional area.

4. The container of claim 1, wherein the actuating surface cross-sectional area is at least 100% larger than the valve cup cross-sectional area.

5. The container of claim 1, wherein:

the plastic vessel has a shoulder portion adjacent to the neck portion, the shoulder portion having a geometric shape and a shoulder portion cross-sectional area that is larger than the valve cup cross-sectional area; and the sidewall on the actuator body is configured to form a continuation of the geometric shape of the shoulder portion of the plastic vessel.

* * * * *